US006835096B2

(12) United States Patent
Togashi

(10) Patent No.: US 6,835,096 B2
(45) Date of Patent: Dec. 28, 2004

(54) CONNECTING STRUCTURE OF COAXIAL CABLE AND COAXIAL CONNECTOR

(75) Inventor: Koji Togashi, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/615,209

(22) Filed: Jul. 7, 2003

(65) Prior Publication Data

US 2004/0018771 A1 Jan. 29, 2004

(30) Foreign Application Priority Data

Jul. 23, 2002 (JP) ..... 2002-214586

(51) Int. Cl.[7] ..... H01R 4/18; H01R 9/05
(52) U.S. Cl. ..... 439/578; 174/88 C
(58) Field of Search ..... 439/578–585; 385/100–114; 174/88 C

(56) References Cited

U.S. PATENT DOCUMENTS 5,501,615 A * 3/1996 Inaba et al. ..... 439/578
6,083,030 A * 7/2000 Wright ..... 439/352
6,517,379 B2 * 2/2003 Leve ..... 439/578
6,736,674 B2 * 5/2004 Korte et al. ..... 439/578
2004/0077215 A1 * 4/2004 Palinkas et al. ..... 439/578

* cited by examiner

*Primary Examiner*—Michael C. Zarroli
(74) *Attorney, Agent, or Firm*—Darby & Darby

(57) ABSTRACT

A connecting structure of a coaxial cable and a coaxial connector of the present invention satisfies both tensile strength and high-frequency performance. The coaxial cable and coaxial connector are electrically and mechanically connected by caulking a sleeve. An outside contour of the cross section of the caulked sleeve has an almost circular shape since the caulked sleeve having a crimp height H1 is formed by jointing two opposing almost semi-circular members. The outside contour of each of the semi-circular members has a radius R1 so that R1 and H1 satisfy Equations (1) and (2), respectively:

$$R1=P1\times(D+2\times T1) \quad (1)$$

$$H1=P2\times R1 \quad (2)$$

where D is an outside diameter of the coaxial cable, T1 is a plate thickness of the sleeve, P1 is within the range from 0.45 to 0.48, and P2 is within the range from 2.02 to 2.12.

6 Claims, 10 Drawing Sheets

CONNECTING STRUCTURE OF COAXIAL CABLE AND COAXIAL CONNECTOR

BACKGROUND OF THE INVENTION

1. Field of the Invention

The present invention provides a connecting structure of a coaxial cable and a coaxial connector.

2. Description of the Related Art

A conventional connecting structure of a coaxial cable and a coaxial connector electrically and mechanically connects a coaxial cable and a coaxial connector. A braided conductor is exposed at an end of the coaxial cable. Connecting conductor portions formed continuously from an end of a shell (for example, a grounded shell) of the coaxial connector are inserted into a space between the braided conductor and a metal tape conductor (or a dielectric material) inside the braided conductor. Then, a cylindrical sleeve is caulked.

Conventional examples of the outside contours of the cross section of the caulked sleeve 4 are shown in FIGS. 12–14. FIG. 12 shows an outside contour 101 of the cross section of the caulked sleeve 4 formed into an almost hexagonal shape (type 1); FIG. 13 shows an outside contour 102 of the cross section of the caulked sleeve 4 formed into an almost elliptical shape (type 2); and FIG. 14 shows an outside contour 103 of the cross section of the caulked sleeve 4 which is shaped like a letter O (type 3).

However, it is difficult to have sufficient tensile strength and high-frequency performance at the same time using the conventional examples of a caulked sleeve 4 as shown in FIGS. 12–14.

For example, when the outside contour of the cross section of the caulked sleeve 4 is shaped as shown in FIG. 12, 13, or 14, the VSWR (Voltage Standing Wave Ratio) deteriorates when the tensile strength is a certain value. In the conventional examples of FIGS. 12–14, this problem occurs since the contours of the cross sections of the dielectric material and the external conductor, which surround the central conductor of the coaxial cable, deform from their original concentric circular shapes. This deformation occurs at a higher degree as the tensile strength increases.

SUMMARY OF THE INVENTION

In view of the foregoing problems, the present invention provides a connecting structure of a coaxial cable and a coaxial connector, which can have sufficient tensile strength and high-frequency performance at the same time.

Extensive experiments have been conducted repetitively to be able to set tensile strength to a certain value while preventing deterioration of high-frequency performance in a connecting structure of a coaxial cable and a coaxial connector by forming the contour of a cross section of a dielectric material 12 and an exterior conductor, which surround a central conductor 11 of a coaxial cable 1, into an almost concentric shape. It was discovered that both of the respective desired ranges of tensile strength and high-frequency performance can be achieved when an outside contour 5 of a cross section of the caulked sleeve 4 having a crimp height H1 is formed into an almost circular shape by jointing two opposing almost semi-circular members 43. An outside contour of each of the two opposing almost semi-circular members 43 has a radius R1 so that R1 and H1 satisfy Equations (1) and (2), respectively:

$$R1=P1\times(D+2\times T1) \text{ and} \quad (1)$$

$$H1=P2\times R1 \quad (2)$$

where D is an outside diameter of the coaxial cable 1, T1 as a plate thickness of the sleeve 4, P1 is a numerical value set within the range from 0.45 to 0.48, and P2 is a numerical value set within the range from 2.02 to 2.12.

The present invention provides a connecting structure of a coaxial cable and a coaxial connector that electrically and mechanically connects a coaxial cable 1 and a coaxial connector 2. In an embodiment of the present invention, an exterior conductor of the coaxial cable 1 comprises a braided conductor 14 and a metal tape conductor 13 that is located inside the braided conductor 14. The braided conductor 14 is exposed at an end of the coaxial cable 1. Connecting conductor portions 26 formed continuously at an end of a shell 21 of the coaxial connector 2 are inserted into a space between the braided conductor 14 and the metal tape conductor 13. Then, the cylindrical sleeve 4 is caulked. An outside contour 5 of a cross section of the caulked sleeve 4 is formed into an almost circular shape having a crimp height H1 by jointing two opposing almost semi-circular members 43. An outside contour of each of the two opposing almost semi-circular members 43 has a radius R1 so that R1 and H1 satisfy Equations (1) and (2) above, respectively, where D is an outside diameter of the coaxial cable 1 and T1 is a plate thickness of the sleeve 4.

According to this embodiment of the present invention, the exterior conductor of the coaxial cable 1 comprises the braided conductor 14 and the metal tape conductor 13. The outside contour 5 of the cross section of the caulked sleeve 4 is formed into an almost circular shape having the crimp height H1 by jointing two opposing almost semi-circular members 43. The outside contour of each of the two opposing almost semi-circular members 43 has the radius R1 so that R1 and H1 satisfy Equations (1) and (2) above, respectively. Therefore, deterioration of high-frequency performance can be prevented without sacrificing tensile strength, and the respective desired ranges of both tensile strength and high-frequency performance can be achieved.

In another embodiment of the present invention, a connecting structure of a coaxial cable and a coaxial connector for electrically and mechanically connecting a coaxial cable 1 and a coaxial connector 2 is provided. The coaxial cable 1, according to this embodiment of the present invention, comprises an exterior conductor which only comprises a braided conductor 14. A dielectric material 12 is located inside the braided conductor 14. The braided conductor 14 is exposed at an end of the coaxial cable 1, and connecting conductor portions 26 formed continuously at an end of a shell 21 of the coaxial connector 2 are inserted into a space between the braided conductor 14 and the dielectric material 12. Then, the cylindrical sleeve 4 is caulked. Therefore, an outside contour 5 of a cross section of the caulked sleeve 4 is formed into an almost circular shape having a crimp height H1 by jointing two opposing almost semi-circular members 43. An outside contour of each of the two opposing almost semi-circular members 43 has a radius R1 so that R1 and H1 satisfy Equations (1) and (2) above, respectively, where D is an outside diameter of the coaxial cable 1 and T1 is a plate thickness of the sleeve 4.

In the connecting structure of the coaxial cable 1 and the coaxial connector 2 according to this embodiment of the present invention in which the exterior conductor of the coaxial cable 1 comprises the braided conductor 14 alone, the outside contour 5 of the cross section of the caulked sleeve 4 is arranged in the same manner as the outside contour 5 of the cross section of the caulked sleeve 4 according to the embodiment of the present invention in which the exterior conductor of the coaxial cable 1 comprises the braided conductor 14 and the metal tape conductor 13. Therefore, deterioration of high-frequency performance can be prevented without sacrificing tensile strength while being able to achieve the respective desired ranges of both tensile strength and high-frequency performance.

Another embodiment of the present invention provides the connecting structure of a coaxial cable and a coaxial connector according to any of the embodiments described above. Furthermore, an outside contour of a cross section of a joint portion 42 which connects each end of an outside contour of the cross section of the two opposing almost semi-circular members 43, which each have the radius R1, to an outside contour 51 of a cross section of protruding strips 41 on an outer circumference of the caulked sleeve 4. Thus, R2 is a curvature radius of the outside contour of the cross section of the joint portion 42 between the outside contour 51 of the cross section of the protruding strips 41 and each end of the outside contour of the cross section of the almost semi-circular members 43 having the radius R1. Additionally, H2 is a height of the outside contour 51 of the cross section of the protruding strips 41 in the direction of a crimp height H1. In order to achieve the respective desired control ranges of both tensile strength and high-frequency performance in a stable manner, the curvature radius R2 and the height H2 satisfy Equations (3) and (4), respectively:

$$R2=P3\times T1) \text{ and} \quad (3)$$

$$H2=P4\times R1 \quad (4)$$

where P3 is a numerical value set within the range from 1.8 to 2.2 and P4 is a numerical value set within the range from 1.5 to 2.0.

According to this embodiment of the present invention, the outside contour of the cross section of the joint portion 42 connects each end of the outside contour of the cross section of the two opposing almost semi-circular members 43 having the radius R1 to the outside contour 51 of the cross section of the protruding strips 41 on the outer circumference of the caulked sleeve 4. The curvature radius R2 of the outside contour of the cross section of the joint portion 42 between the outside contour 51 of the cross section of the protruding strips 41 and each end of the outside contour of cross section of the almost semi-circular members 43 with the radius R1 satisfies Equation (3). Additionally, the height H2 of the outside contour 51 of the cross section of the protruding strips 41 in the direction of the crimp height H1 satisfies Equation (4). Thus, both tensile strength and high-frequency performance can be achieved in a stable manner within their respective desired ranges.

BRIEF DESCRIPTION OF THE DRAWINGS

These and other objects and advantages of the present invention will become clear from the following description with reference to the accompanying drawings, wherein:

FIG. 1(*b*) is an enlarged vertical cross-section taken along the line 1(*b*)—1(*b*) of FIG. 4(*a*) of a connecting structure through the sleeve of FIG. 1(*a*) after the sleeve is caulked;

FIG. 1(*c*) is an explanatory view showing the shape of the sleeve of FIG. 1(*b*) of a connecting structure of the coaxial cable and the coaxial connector according to an embodiment of the present invention;

FIG. 4(*b*) is a cross section taken along the line 4(*b*)—4(*b*) of FIG. 4(*a*);

DETAILED DESCRIPTION OF THE PREFERRED EMBODIMENTS

Figure 1A:
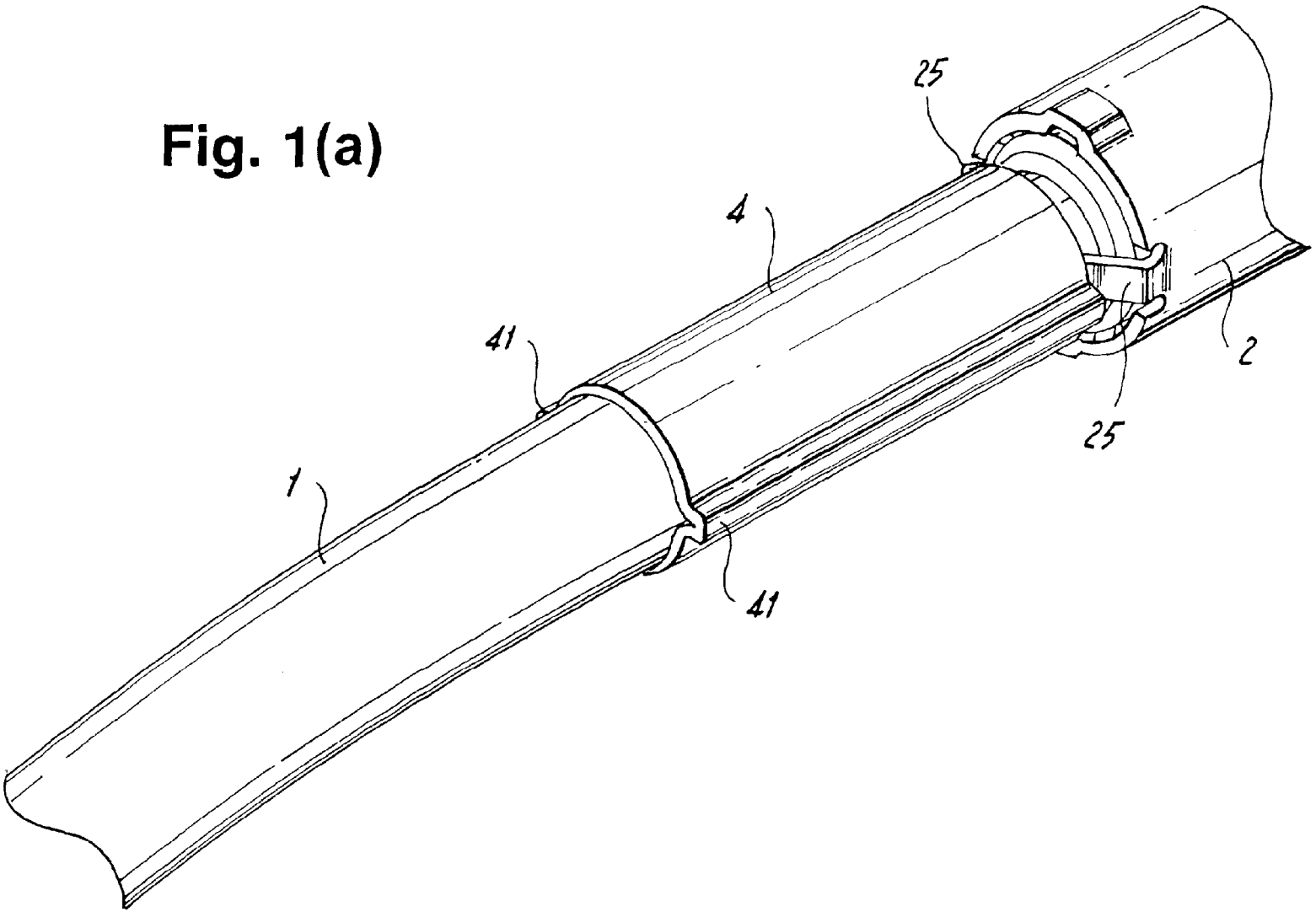
FIG. 1(*a*) is a perspective view showing a coaxial cable and a coaxial connector which are connected by caulking a sleeve according to an embodiment of the present invention.
Figure 1B:
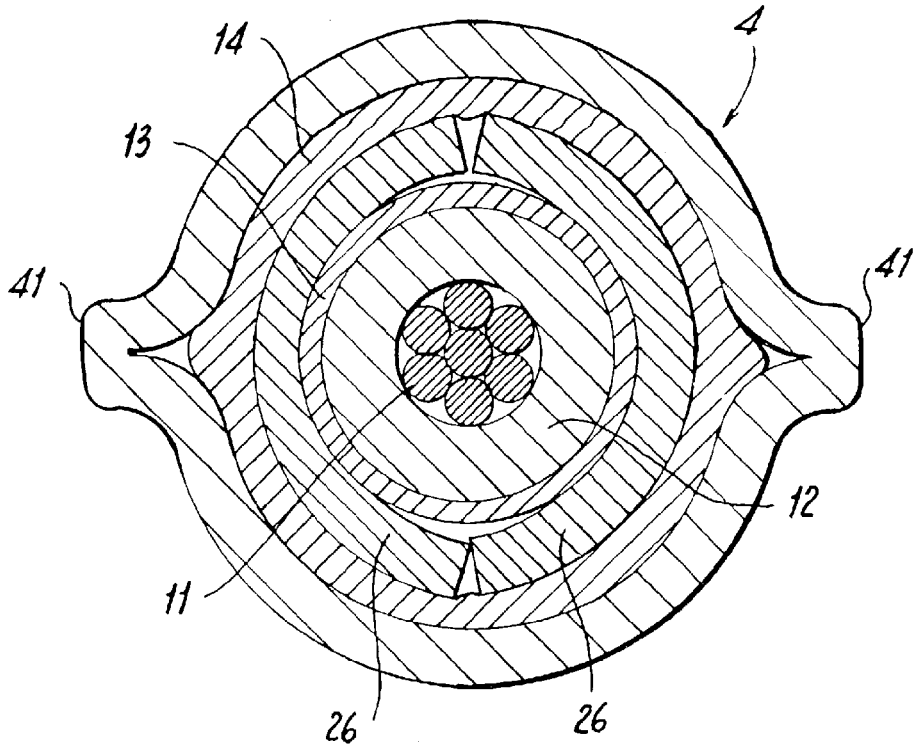
Figure 1C:
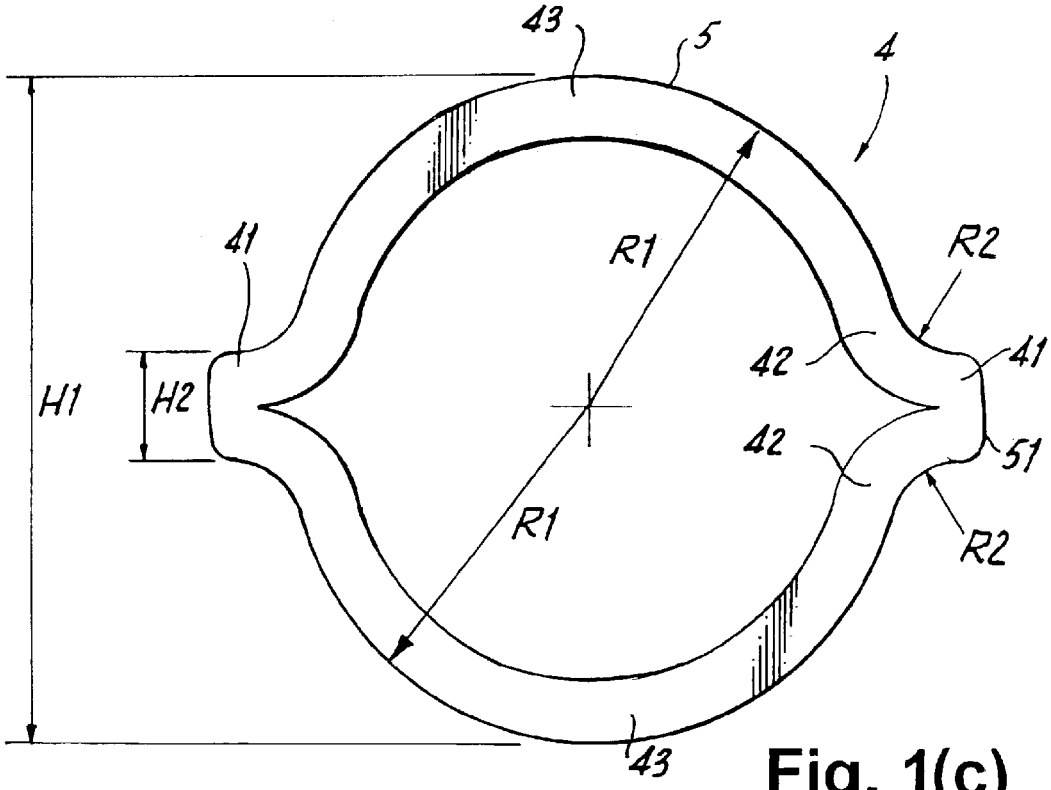

An embodiment of the present invention provides a connecting structure of a coaxial cable and a coaxial connector as shown in FIGS. 1(*a*)–1(*c*).

FIGS. 1(*a*)–1(*c*) show a coaxial cable 1 having an outside diameter D, a coaxial connector 2 (for example, a receptacle type coaxial connector), and a cylindrical sleeve 4. The sleeve 4 has a plate thickness T1 when it is caulked. FIG. 1(*a*) is a perspective view showing a portion of the coaxial cable 1 and the coaxial connector 2, which are electrically and mechanically connected by caulking the sleeve 4. FIG. 1(*b*) is an enlarged vertical cross section through the sleeve 4 of FIG. 1(*a*) of a portion of the connecting structure of the coaxial cable 1 and the coaxial connector 2. FIG. 1(*c*) is an explanatory view used to specify the shape of the sleeve 4 of FIG. 1(*b*).

Figure 2:
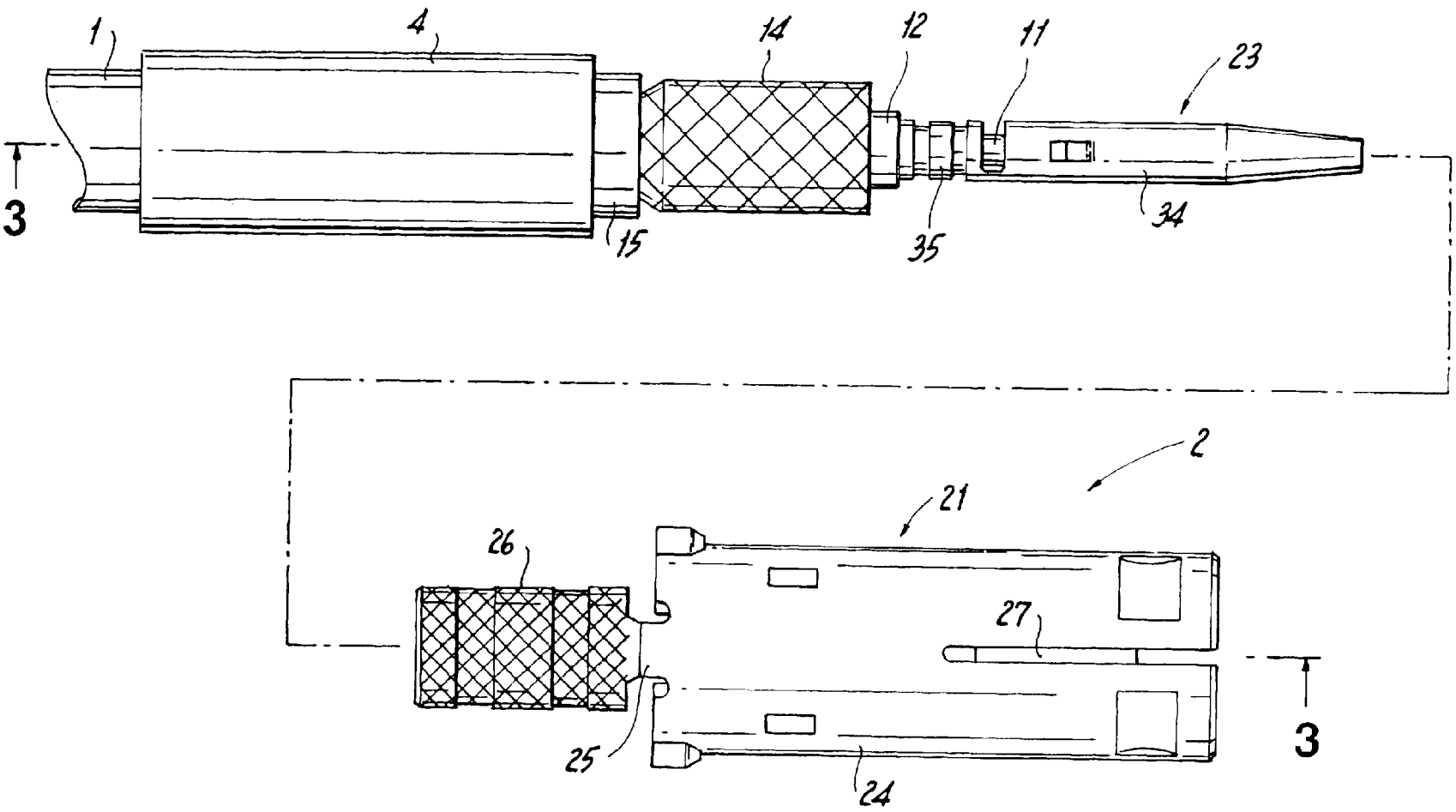
FIG. 2 is a view showing a configuration of an embodiment of the present invention immediately before connecting conductor portions of the coaxial connector are inserted into a space between a braided conductor and a metal tape conductor of the coaxial cable.
Figure 3:
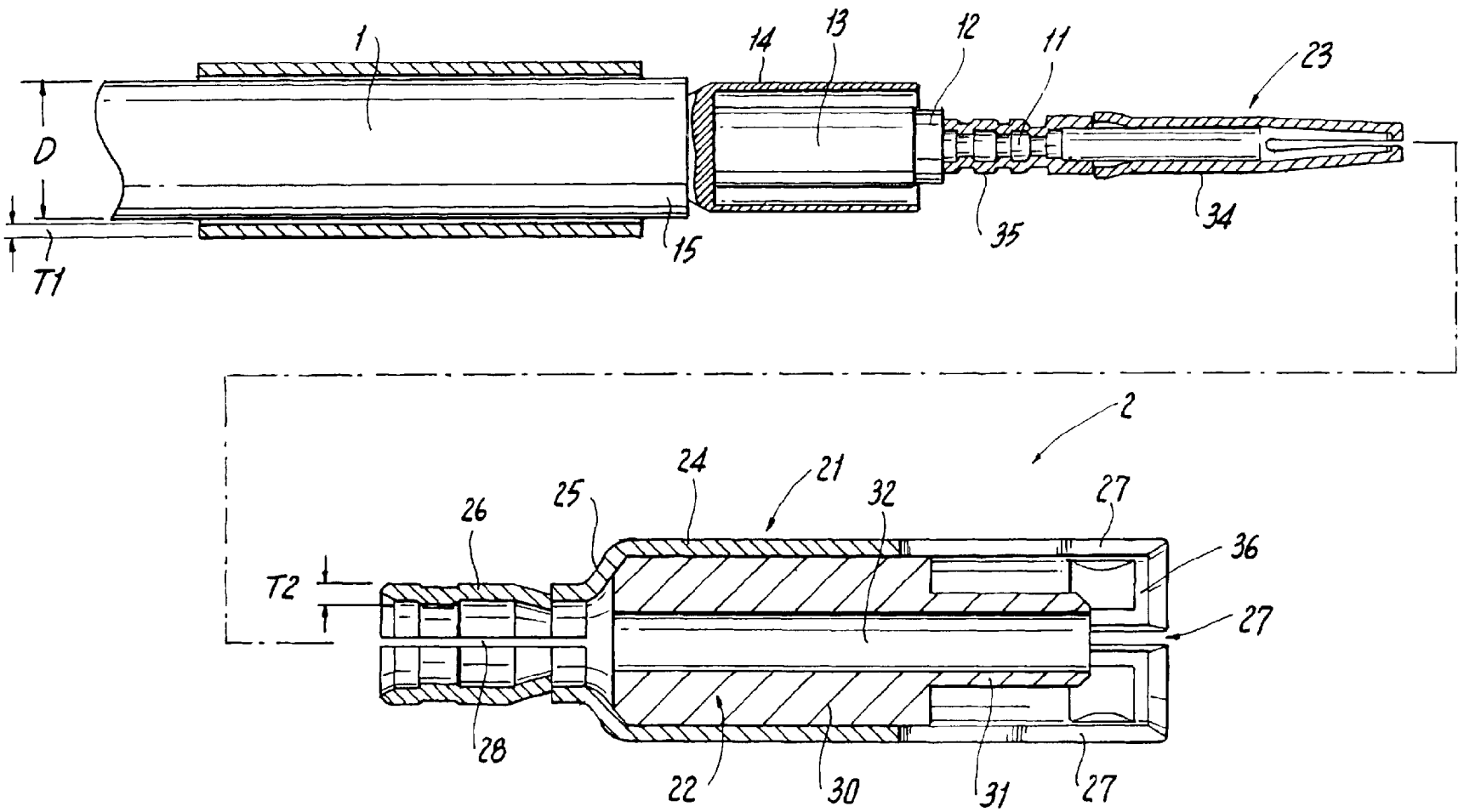
FIG. 3 is a cross section taken along the line 3—3 of FIG. 2.
Figure 4A:
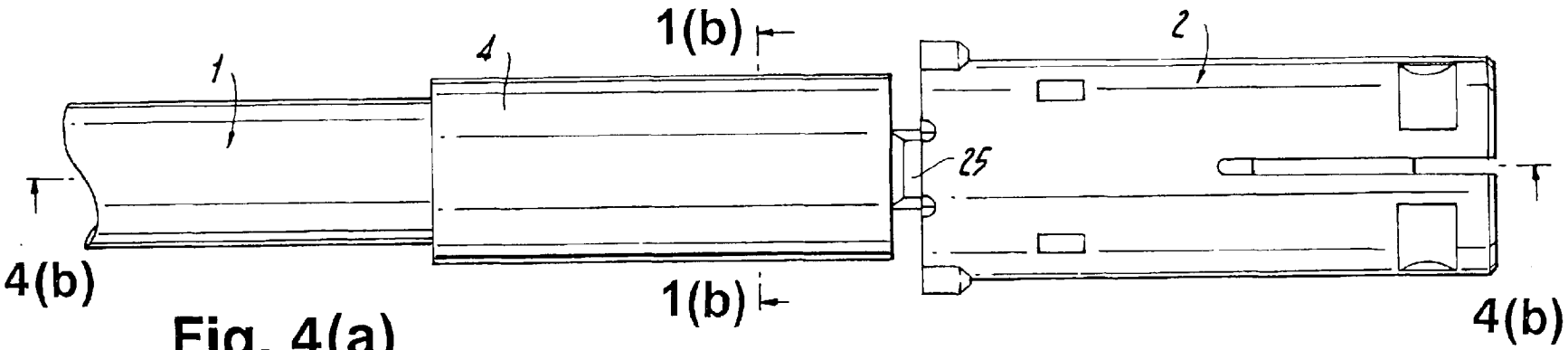
FIG. 4(*a*) is a view showing a configuration of an embodiment of the present invention after the connecting conductor portions of the coaxial connector are inserted into the space between the braided conductor and the metal tape conductor of the coaxial cable and before the sleeve is caulked.
Figure 4B:
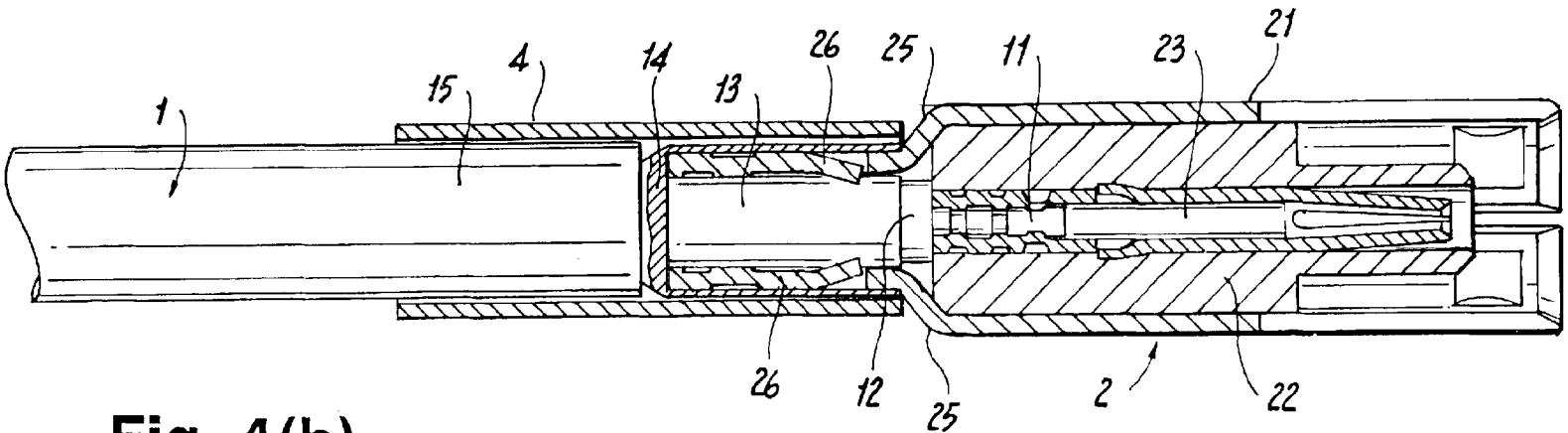

As shown in FIGS. 2–4(*b*), the coaxial cable 1 comprises a central conductor 11, a dielectric material 12, an external conductor comprising a metal tape conductor 13 and a braided conductor 14, and a housing 15, which are formed concentrically.

As shown in FIGS. 2–4(*b*), the coaxial connector 2 comprises a shell 21 (for example, a grounded shell), an insulator 22, and a central contact 23.

The shell 21 comprises a cylindrical holder tube portion 24 and connecting conductor portions 26 coupled by coupling portions 25 to the rear end of the holder tube portion 24.

Slots 27 are located on the tip end of the holder tube portion 24 of the shell 21 along the axial direction.

The connecting conductor portions 26 of the shell 21 have a concavo-convex corrugated cross section along the axial direction that increases tensile strength of the connecting structure since the connecting conductor portions 26 of the shell 21 bite into the metal tape conductor 13 after the sleeve 4 is caulked. The connecting conductor portions 26 of the shell 21 are tube-like semi-circular members formed by dividing a cylinder with an inside diameter which is slightly larger than the outside diameter of the metal tape conductor 13. The cylinder is divided into halves along clearances 28.

Twill-like notches are formed on the outer circumferential surfaces of the connecting conductor portions 26 of the shell 21, and the tip end of the connecting conductor portions 26 of the shell 21 is tapered so that the connecting conductor portions 26 can be readily inserted into the coaxial cable 1.

An apparent plate thickness T2 (for example, T2=0.4 mm) of the connecting conductor portions 26 of the shell 21 is slightly larger than the actual plate thickness as shown in FIG. 3 because the cross section of the connecting conductor portions 26 in the axial direction has a concavo-convex corrugated shape. The apparent plate thickness T2 is equal or nearly equal to the thickness of the housing 15.

The insulator 22 is made of a dielectric material such as polyethylene resin or the like. The insulator 22 comprises a cylindrical press-fit portion 30 and a cylindrical fitting portion 31. The fitting portion 31 of the insulator 22 is formed continuously as one body with the press-fit portion 30 of the insulator 22, and the fitting portion 31 has an outside diameter which is less than the outside diameter of the press-fit portion 30. A contact attachment hole 32 is formed through the central axis of the press-fit portion 30 and the fitting portion 31.

The central contact 23 has a negative form and is made of conductive metal (for example, phosphor bronze). The central contact 23 comprises a cylindrical fitting portion 34 with forked tapers at the tip end and a compression bonding portion 35 formed continuously with the rear end of the fitting portion 34 so that the central contact 23 has a U-shaped cross section. The compression bonding portion 35 of the central contact 23 has a concavo-convex corrugated cross section that increases the tensile strength of the connecting structure when the compression bonding portion 35 of the central contact 23 bites into the central conductor 11 after being bonded by compression bonding.

The sleeve 4 has a cylindrical shape and is made of conductive metal (for example, brass). The inside diameter of the sleeve 4 is slightly larger than the outside diameter D of the coaxial cable 1 to allow the coaxial cable 1 to be inserted through the sleeve 4 without leaving any clearance.

A method for connecting a coaxial cable and a coaxial connector by caulking the sleeve 4 will now be explained with reference to FIGS. 2–5.

The press-fit portion 30 of the insulator 22 is press-fit into the holder tube portion 24 of the shell 21 from the tip end of the holder tube portion 24 of the shell 21. Due to the press-fitting of the press-fit portion 30 of the insulator 22, a fitting portion 36 of the coaxial connector 2 is located between the inner wall surface on the tip end of the holder tube portion 24 of the shell 21 and the outer wall surface of the fitting portion 31 of the insulator 22. The fitting portion of a mating coaxial connector (for example, a plug type coaxial connector) (not shown) fits into the fitting portion. 36 of the coaxial connector 2.

Then, certain portions of the housing 15, the braided conductor 14, the metal tape conductor 13, and the dielectric material 12 of the coaxial cable 1 are peeled at the end that is the connecting side of the coaxial cable 1. Thus, as shown in FIGS. 2 and 3, the tip ends of the central conductor 11, the dielectric material 12, and the braided conductor 14 are exposed, and the central conductor 11 is inserted into the compression bonding portion 35 of the central contact 23. Subsequently, the compression bonding portion 35 of the central contact 23 is caulked and is thereby bonded to the central conductor 11 by compression bonding.

Then, the coaxial cable 1 is inserted through the sleeve 4, and the exposed braided conductor 14 is unraveled to form a space between the braided conductor 14 and the metal plate conductor 13. Thus, the connecting conductor portions 26 of the coaxial connector 2 can be inserted into the space between the braided conductor 14 and the metal plate conductor 13. The connecting structure is configured as shown in FIGS. 2 and 3.

Then, the connecting conductor portions 26 of the coaxial connector 2 are inserted into the space between the braided conductor 14 and the metal tape conductor 13 formed as described above. Next, the sleeve 4 is slid onto the outer wall surface of the braided conductor 14 in which the connecting conductor portions 26 have been inserted. Thus, the connecting structure is configured as shown in FIGS. 4(*a*) and 4(*b*).

Figure 5:
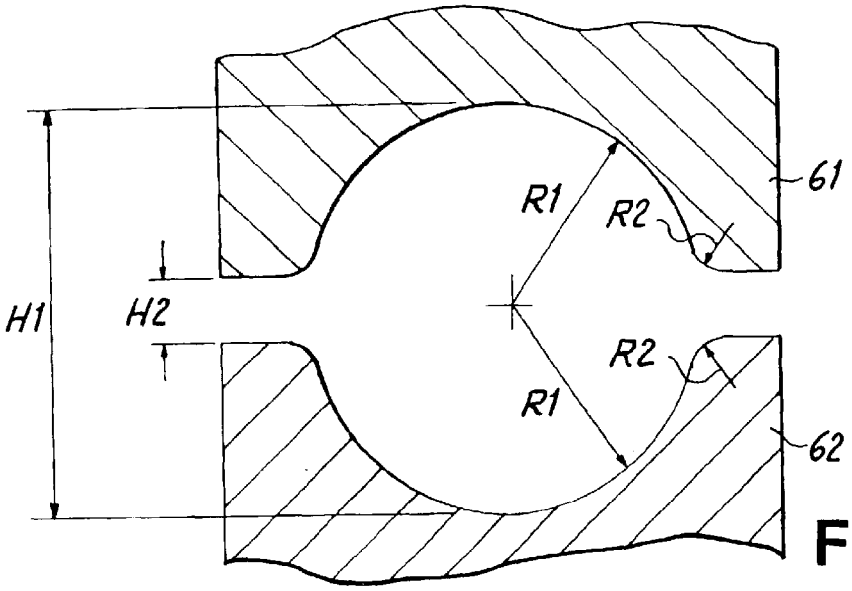
FIG. 5 is an explanatory view of an upper die and a lower die for crimping which are attached to a compression bonding machine (for example, a pressing machine) used to caulk the sleeve of FIGS. 4(*a*) and 4(*b*)

Then, the sleeve 4 is caulked by compression bonding using an upper die 61 (corresponding to a general-purpose punch) and a lower die 62 (corresponding to a general-purpose anvil) for crimping as shown in FIG. 5. By caulking the sleeve 4, the semi-circular crimp surfaces on the top outer surface and the bottom outer surface of the sleeve 4 have a radius R1 and the caulked sleeve has a crimp height H1. The protruding strips 41 of the sleeve 4 that project from the semi-circular crimp surfaces of the sleeve 4 are formed as the result of caulking and crimping. The protruding strips 41 of the sleeve 4 have a height H2. A joint portion 42 is formed between the opposing almost semi-circular members 43 with the semi-circular crimp surfaces and the protruding strips 41. The outside contour of the cross section of the joint portion 42 has a curvature radius R2. Thus, the connecting structure is compression-bonded as shown in FIG. 1(*c*), and the coaxial cable 1 and the coaxial connector 2 are connected electrically and mechanically.

The outside contour 5 of the cross section of the caulked sleeve 4 has an almost circular shape since the sleeve 4 has the crimp height H1 satisfying Equation (2) and is formed by jointing two opposing almost semi-circular members 43. Each of the almost semi-circular members 43 have an outside contour with the radius R1 satisfying Equation (1). The outside contour of the cross section of the joint portion 42 of the caulked sleeve 4 connects each end of the outside contour of the cross section of the two almost semi-circular members 43 to the outside contour 51 of the cross section of the protruding strips 41 on the outer circumference of the caulked sleeve 4. The curvature radius R2 of the outside contour of the cross section of the joint portion 42 between the outside contour 51 of the cross section of the protruding strips 41 and each end of the outside contour of cross section of the almost semi-circular members 43 with the radius R1 satisfies Equation (3). Additionally, the height H2 of the outside contour 51 of the cross section of the protruding strips 41 in the direction of the crimp height H1 satisfies Equation (4).

The central conductor 11 of FIGS. 1(*a*)–4(*b*) is not limited to a twisted wire. However, the embodiment of the present invention as shown in FIG. 1(*b*) comprises a twisted wire. Although the central conductor 11 is shown as a single wire in FIGS. 2–4(*b*) for ease of illustration, the central conductor 11 of this embodiment of the present invention is a twisted wire as shown in FIG. 1(*b*).

The characteristic plot of the connecting structure of the coaxial cable 1 and the coaxial connector 2 assembled as described above will now be explained.

Figure 6:
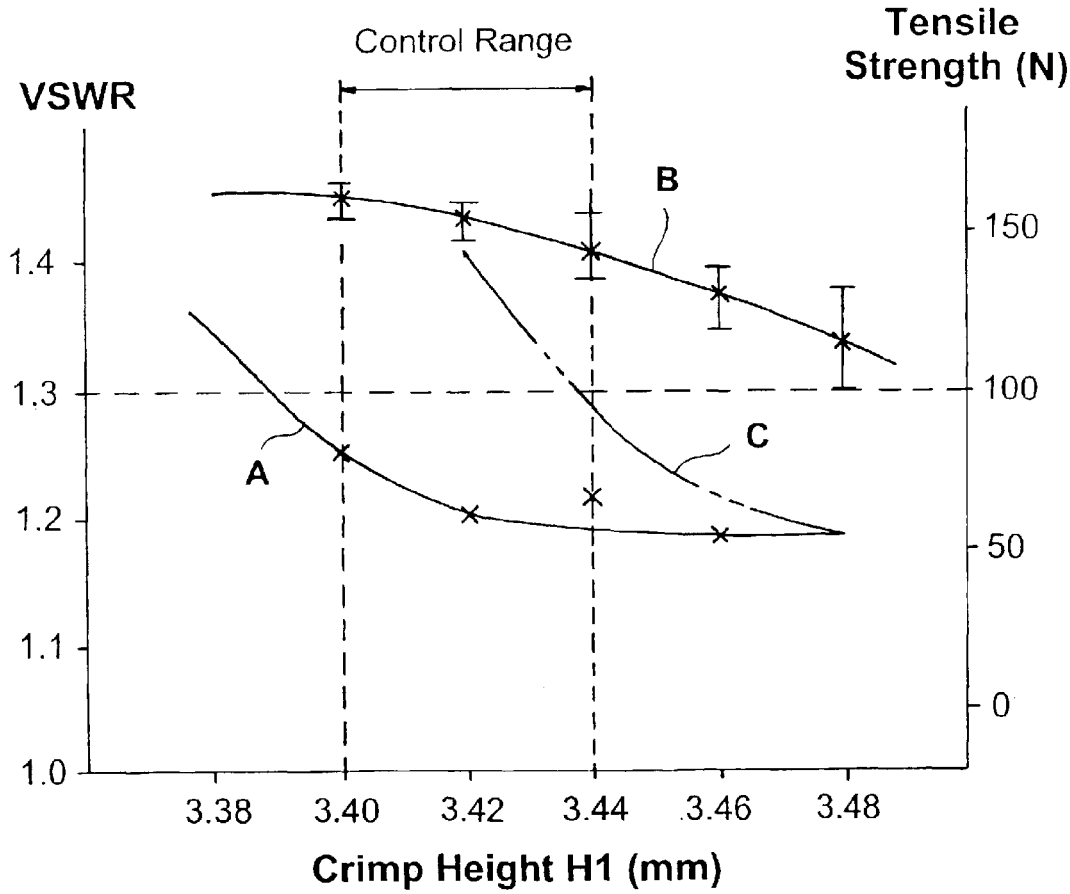
FIG. 6 is a characteristic plot of VSWR and tensile strength versus a crimp height H1 for an embodiment of the present invention shown in FIGS. 1(*a*)–1(*c*)

FIG. 6 shows VSWR (Voltage Standing Wave Ratio), which is an example of high-frequency performance, and tensile strength versus the crimp height H1. The characteristic plots of VSWR and tensile strength were measured under an applied frequency of 5.8 GHz, and the outside diameter D of the coaxial cable 1 was 3.0 mm, the plate thickness T1 of the sleeve 4 was 0.3 mm, and the apparent plate thickness T2 of the connecting conductor portions 26 of the shell 21 was 0.4 nm. Furthermore, R1, H1, R2, and H2 satisfy Equations (1), (2), (3), and (4), respectively. Thus, the resulting characteristic plots shown in FIG. 6 were obtained.

FIG. 6 shows a curve A representing VSWR versus the crimp height H1 and a curve B representing the mean value of the tensile strength (Newton, N) versus the crimp height H1. FIG. 6 shows that when the crimp height H1 is within the control range from 3.40 mm to 3.44 mm, the VSWR is lower than the target value of 1.3 and the tensile strength is greater than the target value of 100 N.

A similar result is obtained when the outside diameter D of the coaxial cable 1 was other than 3.0 mm. In particular, a satisfactory result was obtained when the outside diameter D of the coaxial cable 1 was within the range from 2.0 mm to 5.0 mm.

The characteristic plot of VSWR in the conventional example is represented by a curve C denoted by a chain double-dashed line in FIG. 6. The curve C of the conventional example indicates that VSWR cannot be lower than the target value of 1.3 unless the degree of caulking is lowered, which sacrifices tensile strength.

The frequency characteristic plots of VSWR will now be explained with reference to FIGS. 7–11.

Figure 7:
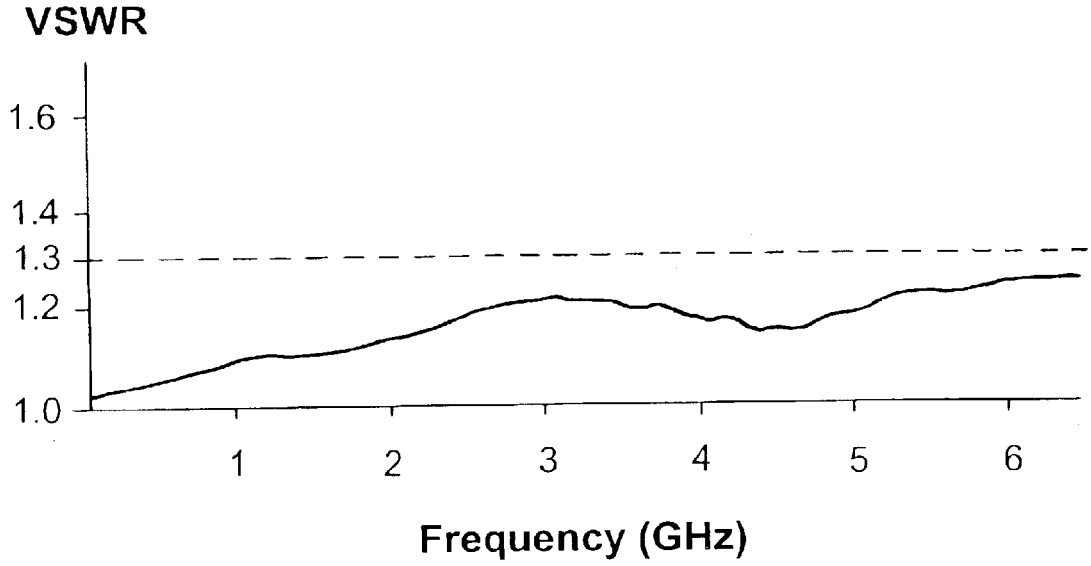
FIG. 7 is a view showing a frequency characteristic plot of VSWR for an embodiment of the present invention shown in FIGS. 1(*a*)–1(*c*)

FIG. 7 shows the frequency characteristic plot of VSWR for this embodiment of the present invention. FIG. 7 reveals that VSWR can be lower than the target value of 1.3 within the frequency range from 1 to 6 GHz.

Figure 8:
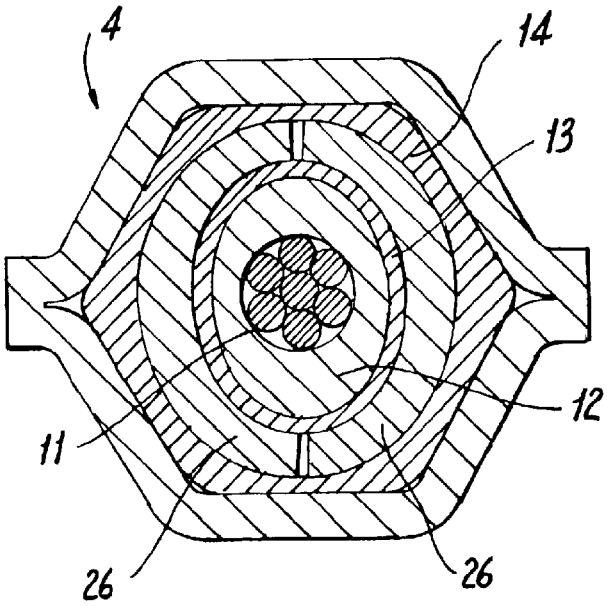
FIG. 8 is an enlarged vertical cross-sectional view of the connecting structure through the sleeve of FIGS. 4(*a*) and 4(*b*) which is caulked into a conventional hexagonal caulked shape (type 1) shown in FIG. 12.
Figure 9:
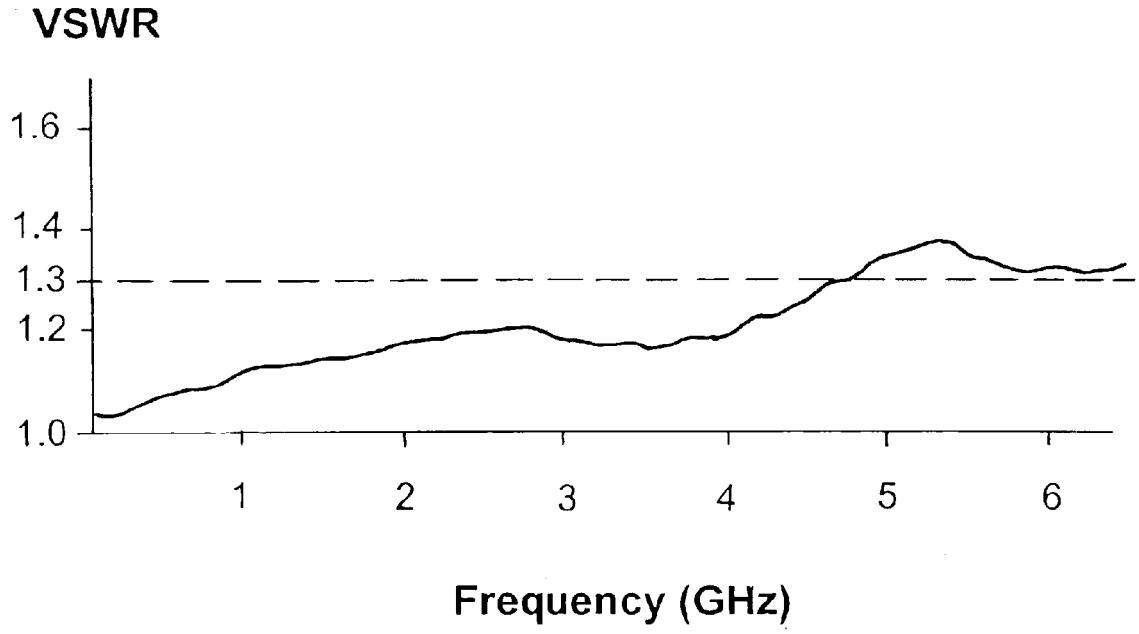
FIG. 9 is a view showing a frequency characteristic plot of VSWR for the connecting structure of FIG. 8.
Figure 10:
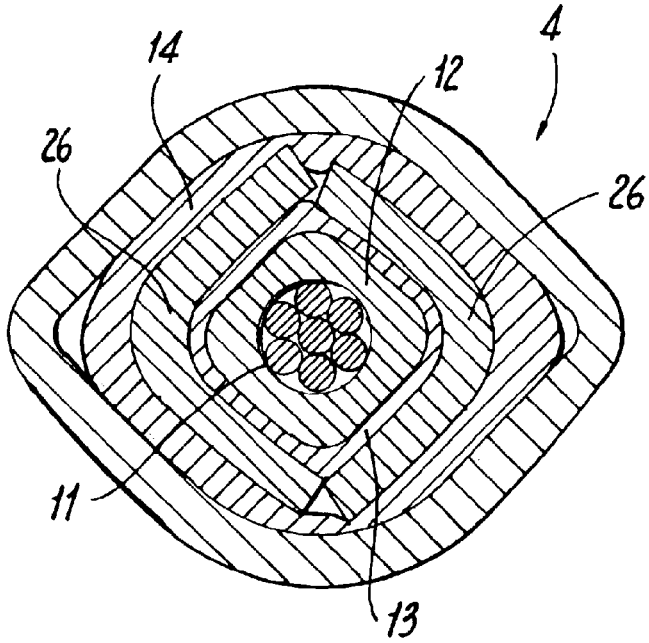
FIG. 10 is an enlarged vertical cross-sectional view of the connecting structure through the sleeve of FIGS. 4(*a*) and 4(*b*) which is caulked into a conventional elliptical caulked shape (type 2) shown in FIG. 13.
Figure 11:
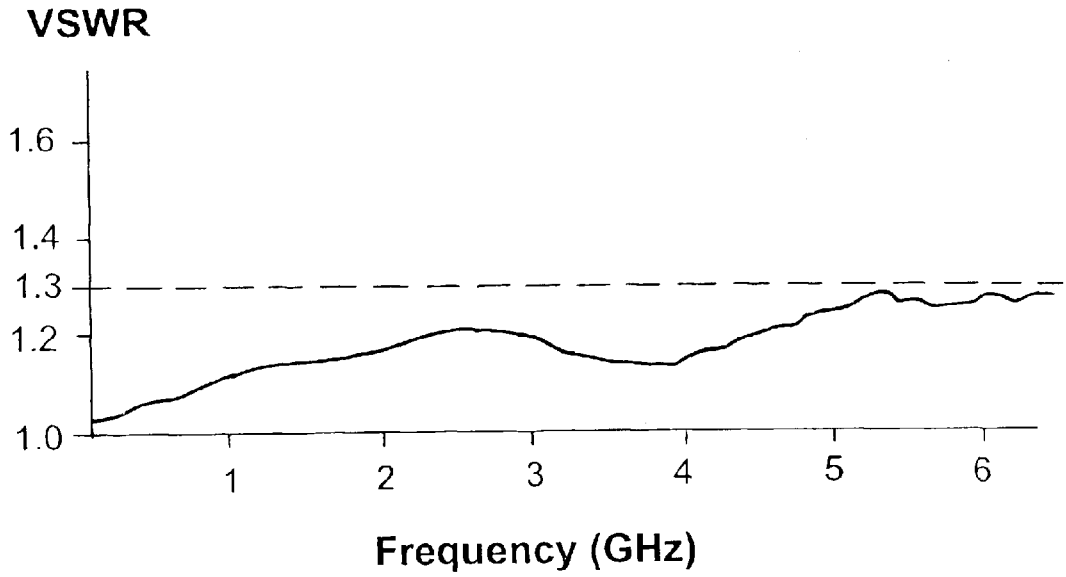
FIG. 11 is a view showing a frequency characteristic plot of VSWR for the connecting structure of FIG. 10.
Figure 12:
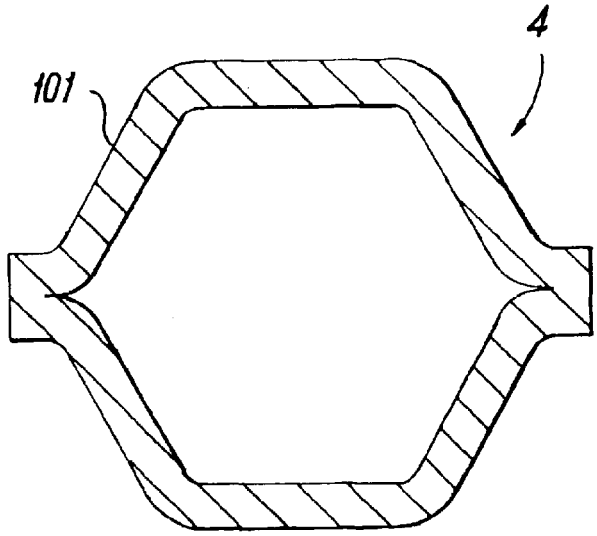
Fig. 12 (Prior Art)
FIG. 12 is a cross-sectional view showing the shape of a conventional example of a caulked sleeve 4 having an almost hexagonal shape (type 1)
Figure 13:
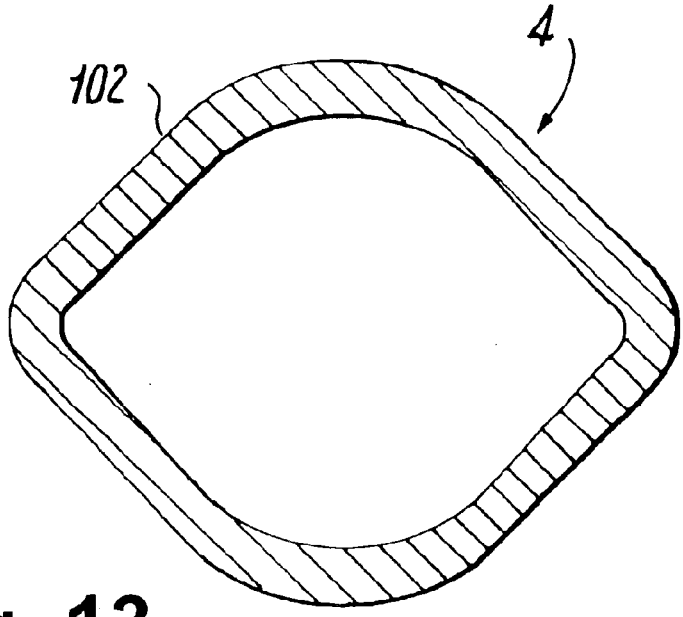
Fig. 13 (Prior Art)
FIG. 13 a cross-sectional view showing the shape of a conventional example of a caulked sleeve 4 having an almost elliptical shape (type 2)
Figure 14:
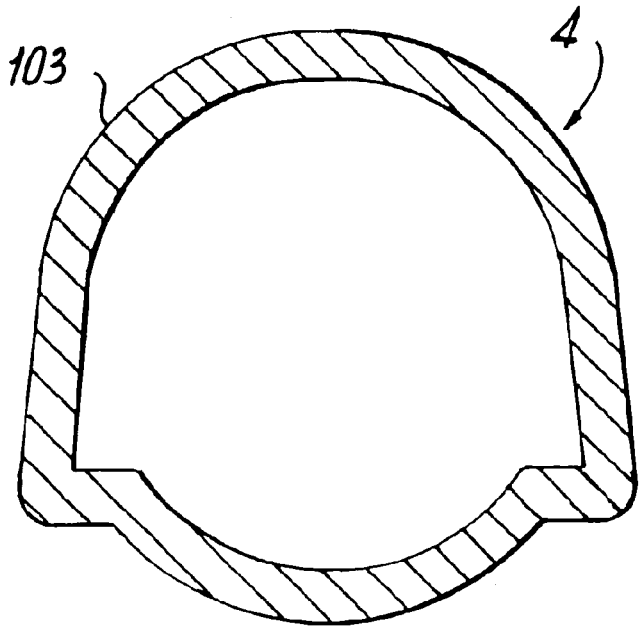
Fig. 14 (Prior Art)
FIG. 14 a cross-sectional view showing the shape of a conventional example of a caulked sleeve 4 which is shaped like a letter O (type 3).

FIGS. 8–11 show comparative examples when the sleeve 4 of FIGS. 4(*a*) and 4(*b*) was caulked in the same manner as the conventional example of type 1 (FIGS. 8 and 9) and in the same manner as the conventional example of type 2 (FIGS. 10 and 11).

For the comparative example in which the sleeve 4 is caulked in the same manner as the conventional example of type 1 as shown in FIG. 8, the frequency characteristic plot is shown in FIG. 9. FIG. 9 shows that the VSWR exceeds the target value of 1.3 in a high-frequency region which ranges approximately from 4.8 to 6 GHz, and the high-frequency performance is thereby deteriorated. For the comparative example in which the sleeve 4 is caulked in the same manner as the conventional example of type 2 as shown in FIG. 10, the frequency characteristic plot is shown in FIG. 11. FIG. 11 shows that the VSWR is equal to or lower than the target value of 1.3 in the frequency range from 1 to 6 GHz. However, in the high-frequency region from 5 to 6 GHz, this comparative example is inferior to the embodiment of the present invention shown in FIG. 7.

In the embodiment of the present invention described above, the exterior conductor of the coaxial cable 1 comprises the braided conductor 14 and the metal tape conductor 13. However, it should be appreciated that the present invention is not limited to such a construction. In the present invention, the exterior conductor of the coaxial cable 1 can comprise the braided conductor 14 alone.

In the embodiment of the present invention in which the coaxial cable 1 comprises the braided conductor 14 alone, the connecting structure of the coaxial cable 1 and the coaxial connector 2 is formed by exposing the braided conductor 14 at the end of the coaxial cable 1. Then, the connecting conductor portions 26 formed continuously from the end of the shell 21 of the coaxial connector 2 are inserted into a space between the braided conductor 14 and the dielectric material 12 inside the braided conductor 14. Next, the sleeve 4 is caulked.

In this embodiment of the present invention, for both high frequency performance and tensile strength to be stable within their respective desired control ranges, the outside contour of the cross section of the joint portion 42 connects each end of the two opposing almost semi-circular members 43 with the outside contour with the radius R1 to the outside contour 51 of the cross section of the protruding strips 41 of the caulked sleeve 4. The curvature radius R2 of the outside contour of the cross section of the joint portion 42 between the outside contour 51 of the cross section of the protruding strips 41 of the caulked sleeve 4 and each end of outside contour of the semi-circular members 43 with the radius R1 satisfies Equation (3). Additionally, the height H2 of the outside contour 51 of the cross section of the protruding strips 41 in the direction of the crimp height H1 satisfies Equation (4), where P3 is a numerical value within the range from 1.8 to 2.2 and P4 is a numerical value within the range from 1.5 to 2.0. However, it should be appreciated that the invention is not limited to this particular embodiment.

For example, in the present invention, R2 and H2 can satisfy Equations (3) and (4), respectively, but one or both of P3 and P4 in Equations (3) and (4), respectively, are set as numerical values within ranges which are different from the respective ranges in the embodiment of the present invention described above, i.e., P3 is a numerical value within the range from 1.8 to 2.2 and/or P4 is a numerical value within the range from 1.5 to 2.2.

While there has been described what are at present considered to be embodiments of the present invention, it will be understood that various modifications may be made thereto, and it is intended that the appended claims cover all such modifications as fall within the true spirit and scope of the invention.

What is claimed is:

1. A connecting structure of a coaxial cable and a coaxial connector for electrically and mechanically connecting said coaxial cable and said coaxial connector, said connecting structure comprising:

a braided conductor exposed on an end of said coaxial cable;

a metal tape conductor inside said braided conductor on said coaxial cable;

connecting conductor portions formed continuously on an end of a shell of said coaxial connector, said connecting conductor portions being inserted into a space between said braided conductor and said metal tape conductor; and a caulked, cylindrical sleeve having a crimp height H1, said sleeve formed by jointing two opposing almost semi-circular members, an outside contour of each said almost semi-circular member having a radius R1 so that said radius R1 and said crimp height H1 satisfy the following Equations (1) and (2), respectively:

$$R1=P1\times(D+2\times T1) \text{ and} \quad (1)$$

$$H1=P2\times R1 \quad (2)$$

where D is an outside diameter of said coaxial cable, T1 is a plate thickness of said sleeve, P1 is a numerical value set within the range from 0.45 to 0.48, and P2 is a numerical value set within the range from 2.02 to 2.12.

2. The connecting structure of a coaxial cable and a coaxial connector according to claim 1, further comprising:

protruding strips formed on an outer circumference of said caulked sleeve and a joint portion between said almost semi-circular member and said protruding strips; wherein an outside contour of a cross section of said joint portion connects an outside contour of a cross section of said protruding strips to an outside contour of a cross section of said almost semi-circular member;

said outside contour of said cross section of said joint portion has a curvature radius R2 and said outside contour of the cross section of said protruding strips has a height H2 in a direction of said crimp height H1, said curvature radius R2 and said height H2 satisfy the following Equations (3) and (4), respectively:

$$R2=P3\times T1 \text{ and} \quad (3)$$

$$H2=P4\times R1 \quad (4)$$

where P3 is a numerical value set within the range from 1.8 to 2.2 and P4 is a numerical value set within the range from 1.5 to 2.0.

3. A connecting structure of a coaxial cable and a coaxial connector for electrically and mechanically connecting said coaxial cable and said coaxial connector, said connecting structure comprising:

a braided conductor exposed on an end of said coaxial cable;

a dielectric material inside said braided conductor on said coaxial cable;

connecting conductor portions formed continuously on an end of a shell of said coaxial connector, said connecting conductor portions being inserted into a space between said braided conductor and said dielectric material; and a caulked, cylindrical sleeve having a crimp height H1, said sleeve formed by jointing two opposing almost semi-circular members, an outside contour of each said almost semi-circular member having a radius R1 so that said radius R1 and said crimp height H1 satisfy the following Equations (1) and (2), respectively:

$$R1=P1\times(D+2\times T1) \text{ and} \quad (1)$$

$$H1=P2\times R1 \quad (2)$$

where D is an outside diameter of said coaxial cable, T1 is a plate thickness of said sleeve, P1 is a numerical value set within the range from 0.45 to 0.48, and P2 is a numerical value set within the range from 2.02 to 2.12.

4. The connecting structure of a coaxial cable and a coaxial connector according to claim 3, further comprising:

protruding strips formed on an outer circumference of said caulked sleeve and a joint portion between said almost semi-circular member and said protruding strips; wherein an outside contour of a cross section of said joint portion connects an outside contour of a cross section of said protruding strips to an outside contour of a cross section of said almost semi-circular member;

said outside contour of said cross section of said joint portion has a curvature radius R2 and said outside contour of the cross section of said protruding strips has a height H2 in a direction of said crimp height H1, said curvature radius R2 and said height H2 satisfy the following Equations (3) and (4), respectively:

$$R2=P3\times T1 \text{ and} \quad (3)$$

$$H2=P4\times R1 \quad (4)$$

where P3 is a numerical value set within the range from 1.8 to 2.2 and P4 is a numerical value set within the range from 1.5 to 2.0.

5. A method for forming a connecting structure of a coaxial cable and a coaxial connector for electrically and mechanically connecting a coaxial cable and a coaxial connector, said method comprising:

allowing a braided conductor to be exposed from an end of said coaxial cable;

inserting connecting conductor portions formed continuously from an end of a shell of said coaxial connector into a space between said braided conductor and a metal tape conductor inside said braided conductor;

caulking a cylindrical sleeve having a crimp height H1, said step of caulking said sleeve comprising jointing two opposing almost semi-circular members, each almost semi-circular member having a radius R1, said radius R1 and said crimp height H1 satisfying the following Equations (1) and (2), respectively:

$$R1=P1\times(D+2\times T1) \quad (1)$$

$$H1=P2\times R1 \quad (2)$$

where D is an outside diameter of said coaxial cable, T1 is a plate thickness of said sleeve, P1 is a numerical value set within the range from 0.45 to 0.48, and P2 is a numerical value set within the range from 2.02 to 2.12;

said caulked sleeve further comprises protruding strips formed on an outer circumference of said caulked sleeve and a joint portion between said almost semi-circular member and said protruding strips;

an outside contour of a cross section of said joint portion connects an outside contour of a cross section of said protruding strips to an outside contour of a cross section of said almost semi-circular member; and said outside contour of said cross section of said joint portion has a curvature radius R2 and said outside contour of the cross section of said protruding strips has a height H2 in a direction of said crimp height H1, said curvature radius R2 and said height H2 satisfy the following Equations (3) and (4), respectively:

$$R2=P3\times T1 \text{ and} \quad (3)$$

$$H2=P4\times R1 \quad (4)$$

where P3 is a numerical value set within the range from 1.8 to 2.2 and P4 is a numerical value set within the range from 1.5 to 2.0.

6. A method for forming a connecting structure of a coaxial cable and a coaxial connector for electrically and mechanically connecting a coaxial cable and a coaxial connector, said method comprising:

allowing a braided conductor to be exposed from an end of said coaxial cable;

inserting connecting conductor portions formed continuously from an end of a shell of said coaxial connector into a space between said braided conductor and a dielectric material inside said braided conductor;

caulking a cylindrical sleeve having a crimp height H1, said step of caulking said sleeve comprising jointing two opposing almost semi-circular members, each almost semi-circular member having a radius R1, said radius R1 and said crimp height H1 satisfying the following Equations (1) and (2), respectively:

$$R1=P1\times(D+2\times T1) \quad (1)$$

$$H1=P2\times R1 \quad (2)$$

where D is an outside diameter of said coaxial cable, T1 is a plate thickness of said sleeve, P1 is a numerical value set within the range from 0.45 to 0.48, and P2 is a numerical value set within the range from 2.02 to 2.12;

said caulked sleeve further comprises protruding strips formed on an outer circumference of said caulked sleeve and a joint portion between said almost semi-circular member and said protruding strips;

an outside contour of a cross section of said joint portion connects an outside contour of a cross section of said protruding strips to an outside contour of a cross section of said almost semi-circular member; and said outside contour of said cross section of said joint portion has a curvature radius R2 and said outside contour of the cross section of said protruding strips has a height H2 in a direction of said crimp height H1, said curvature radius R2 and said height H2 satisfy the following Equations (3) and (4), respectively:

$$R2=P3\times T1 \text{ and} \quad (3)$$

$$H2=P4\times R1 \quad (4)$$

where P3 is a numerical value set within the range from 1.8 to 2.2 and P4 is a numerical value set within the range from 1.5 to 2.0.

* * * * *